United States Patent [19]

Nakazawa et al.

[11] Patent Number: 4,469,769

[45] Date of Patent: Sep. 4, 1984

[54] PHOTOSENSITIVE MATERIAL FOR ELECTROPHOTOGRAPHY CONTAINS HALO-BENZOQUINONE SENSITIZER

[75] Inventors: Toru Nakazawa, Kumatori; Akira Fushida, Suita; Yasushi Kamezaki, Sakai, all of Japan

[73] Assignee: Mita Industrial Co. Ltd., Osaka, Japan

[21] Appl. No.: 519,233

[22] Filed: Aug. 2, 1983

[30] Foreign Application Priority Data

Aug. 3, 1982 [JP] Japan ..... 57-135478

[51] Int. Cl.[3] ..... G03G 5/06

[52] U.S. Cl. ..... 430/78; 430/79; 430/83; 430/900

[58] Field of Search ..... 430/78, 79, 57, 58, 430/59, 900, 83

[56] References Cited

U.S. PATENT DOCUMENTS

| | | | |
|---|---|---|---|
| 3,037,861 | 6/1962 | Hoegl et al. | 430/58 |
| 3,901,697 | 8/1975 | Krohn et al. | 430/40 |
| 3,904,407 | 9/1975 | Regensburger et al. | 430/58 |
| 4,264,695 | 4/1981 | Kozima et al. | 430/58 |
| 4,315,980 | 2/1982 | Sadamatsu et al. | 430/58 |

*Primary Examiner*—John D. Welsh

*Attorney, Agent, or Firm*—Sherman & Shalloway

[57] ABSTRACT

Disclosed is a photosensitive material for the electrophotography, which comprises a dispersion of a charge-generating pigment in a charge-transporting medium composed mainly of a polyvinyl carbazole resin, wherein a perylene pigment represented by the following general formula:

wherein $R_1$ and $R_2$ stand for a hydrogen atom or a substituted or unsubstituted alkyl or aryl group, is dispersed and incorporated as the charge-generating pigment in an amount of 1 to 40 parts by weight per 100 parts by weight of the polyvinyl carbazole resin and a halogeno-p-benzoquinone is further incorporated in an amount of 1 to 60 parts by weight per 100 parts by weight of the polyvinyl carbazole resin.

5 Claims, 2 Drawing Figures

PHOTOSENSITIVE MATERIAL FOR ELECTROPHOTOGRAPHY CONTAINS HALO-BENZOQUINONE SENSITIZER

BACKGROUND OF THE INVENTION

1. Field of the Invention

The present invention relates to a photosensitive material for the electrophotography. More particularly, the present invention relates to an improvement of a photosensitive material comprising a perylene type pigment dispersed in a polyvinyl carbazole type charge-transporting medium, in which a halogeno-p-benzoquinone is incorporated in this dispersion to increase the sensitivity of the photosensitive material and prevent the fatigue at the repeated exposure.

2. Description of the Prior Art

As the signal-layer type photosensitive material comprising a dispersion of a charge-generating pigment in a charge-transporting medium, there is known a photosensitive material comprising a phthalocyanine pigment or disazo pigment in a medium composed mainly of a polyvinyl carbazole resin, and it is known that a dispersion of a perylene type pigment in a polyvinyl carbazole resin (often referred to as "PVK" hereinafter) has no substantial sensitivity and it can hardly be put into practical use.

Furthermore, it is known that various sensitizing agents may be incorporated so as to sensitize photosensitive layers of the charge-transporting medium/-charge-generating pigment dispersion type. However, when most of these sensitizing agents are incorporated in a PVK-perylene type pigment composition, no satisfactory results are obtain in the sensitivity, the charge potential or the repetition characteristics.

We found that a halonaphthoquinone has a substantially satisfactory sensitizing effect to the PVK-perylene pigment composition. However, a photosensitive material having the halonaphthoquinone incorporated therein is defective in that the fatigue at the repeated exposure, that is, the memory effect, is extreme and the initial saturation charge voltage on the surface of the photosensitive material is drastically reduced by repetition of the light exposure.

SUMMARY OF THE INVENTION

We found that when a halogeno-p-benzoquinone is incorporated in a photosensitive material of the PVK-perylene pigment dispersion type, the fatigue at the repeated exposure is prominently controlled and the sensitivity of the photosensitive material is highly improved. We have now completed the present invention based on this finding.

More specifically, in accordance with the present invention, there is provided a photosensitive material for the electrophotography, which comprises a dispersion of a charge-generating pigment in a charge-transporting medium composed mainly of a polyvinyl carbazole resin, wherein a perylene pigment represented by the following general formula:

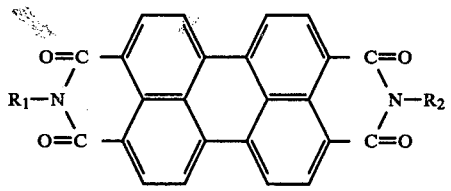

wherein $R_1$ and $R_2$ stand for a hydrogen atom or a substituted or unsubstituted alkyl or aryl group, is dispersed and incorporated as the charge-generating pigment in an amount of 1 to 40 parts by weight per 100 parts by weight of the polyvinyl carbazole resin and a halogeno-p-benzoquinone is further incorporated in an amount of 1 to 60 parts by weight per 100 parts by weight of the polyvinyl carbazole resin.

DETAILED DESCRIPTION OF THE INVENTION

Figure 1:
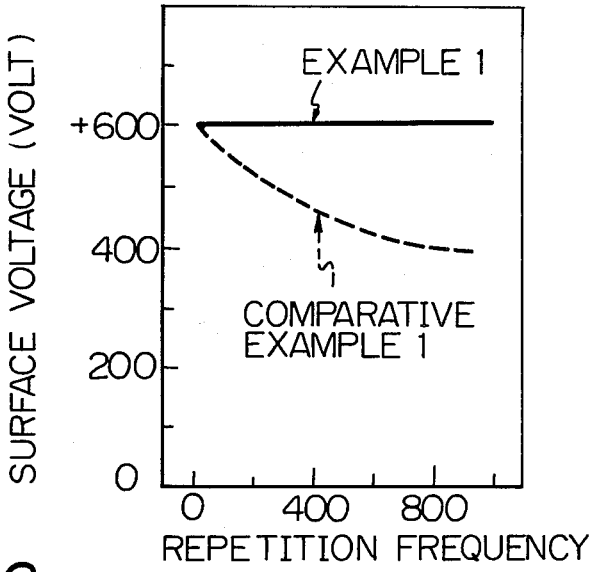
FIGS. 1 and 2 are graphs showing the repetition characteristics of a photosensitive material according to the present invention and a comparative photosensitive material, respectively.

As the halogeno-p-benzoquinone, 2,5-dichloro-p-benzoquinone and 2,6-dichloro-p-benzoquinone are preferably used in the present invention.

These halogeno-p-benzoquinones are known to be active as the electron-receiving substance, and if the halogeno-p-benzoquinone is dispersed and incorporated in combination with the perylene pigment of the above-mentioned structural formula (1) into a charge-transportion medium composed mainly of a polyvinyl carbazole resin, as pointed out hereinbefore, the fatigue at the repeated exposure is prevented and a predetermined charge quantity can always be obtained stably. This is one of prominent characteristic features of the present invention.

When other known electron-receiving substance, for example, 2,3-dichloro-1,4-naphthoquinone or 2,4,7-trinitro-9-fluorenone, is used in combination with a perylene pigment of the structural formula (1), as is seen from the results of Comparative Examples given hereinafter, as the frequency of the repetition of the light exposure is increased, the charge quantity is reduced and when the light exposure is repeated 1000 times, the charge quantity is reduced to about 70% of the initial charge quantity. In contrast, when a halogeno-p-benzoquinone is used in combination with a perylene pigment of the structural formula (1) according to the present invention, reduction of the charge quantity at the repeated exposure is effectively controlled, and even if the light exposure is repeated 1000 times, the charge quantity is not substantially different from the initial charge quantity.

The sensitivity of a photosensitive layer for the electrophotography is expressed by the light exposure quantity (lux·sec) for half-decay of the voltage. The sensitivity of a photosensitive layer of the PBK-perylene pigment dispersion type is about 40 to about 60 lux·sec if the halogeno-p-benzoquinone is not incorporated, but if the halogeno-p-benzoquinone is incorporated in this photosensitive material, the sensitivity can be improved to a level of 10 to 20 lux·sec. Of course, in order to further sensitize the photosensitive layer, a known electron-receiving substance may be used in combination with the halogen-p-benzoquinone in an amount of 1 to 10 parts by weight per part by weight of the halogeno-p-benzoquinone. As the electron-receiving substance, there can be mentioned, for example, carboxylic anhydrides, compounds having an electron-receiving nucleus structure such as an o- or p-quinoid structure, and alicyclic, aromatic and heterocyclic compounds ahving electron-receiving substituents such as nitro, nitroso and cyano groups. As specific examples, there can be mentioned maleic anhydride, phthalic anhydride, tetrachlorophthalic anhydride, tetrabromophthalic anhydride, naphthalic anhydride, pyromellitic anhydride, 5,8-dichloronaphthoquinone, o-chloranil, o-bromanil, p-chloranil, p-bromanil, p-iodanil, tetracyanoquinodimethane, 5,6-quinoline-dione, coumarin-2,2-dione, hydroxyindirubin, hydroxyindigo, 1,2-dinitroethane, 2,2-dinitropropane, 2-nitro-2-nitrosopropane, iminodiacetonitrile, succinonitrile, tetracyanoethylene, 1,1,3,3-tetracyanopropenide, o-, m- and p-dinitrobenzenes, 1,2,3-trinitrobenzene, 1,2,4-trinitrobenzene, 1,3,5-trinitrobenzene, dinitrodibenzyl, 2,4-dinitroacetophenone, 2,4-dinitrotoluene, 1,3,5-trinitrobenzophenone, 1,2,3-trinitroanisole, $\alpha,\beta$-dinitronaphthalene, 1,4,5,8-tetranitronaphthalene, 3,4,5-trinitro-1,2-dimethylbenzene, 3-nitroso-2-nitrotoluene, 2-nitroso-3,5-dinitrotoluene, o-, m- and p-nitronitrosobenzenes, phthalonitrile, terephthalonitrile, isophthalonitrile, benzoyl cyanide, bromobenzyl cyanide, quinoline cyanide, o-xylene cyanide, o-, m- and p-nitrobenzyl cyanide, 3,5-dinitropyridine, 3-nitro-2-pyridone, 3,4-dicyanopyridine, $\alpha$-, $\beta$- and $\gamma$-cyanopyridines, 4,6-dinitroquinone, 4-nitroxanthone, 9,10-dinitroanthracene, 1-nitroanthracene, 2-nitrophenanthrene-quinone, 2,5-dinitrofluoroenone, 2,6-dinitrofluorenone, 3,6-dinitrofluorenone, 2,7-dinitrofluorenone, 2,4,7-trinitrofluorenone, 2,4,5,7-tetranitrofluorenone, 3,6-dinitrofluorenone mandelonitrile, 3-nitrofluorenone mandelonitrile and tetracyanopyrene.

In the present invention, a known perylene pigment represented by the following general formula:

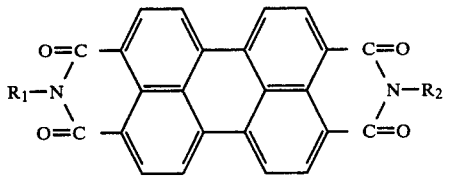

wherein $R_1$ and $R_2$ stand for a hydrogen atom or a substituted or unsubstituted alkyl or aryl group, is used in combination with the halogeno-p-benzoquinone. If this perylene pigment is used in combination with the above-mentioned halogeno-p-benzoquinone, a photosensitive material excellent in the sensitivity and the memory resistance can be obtained. As preferred examples of the substituent, there can be mentioned a hydroxyl group, an alkoxy group, an amino group, a nitro group and a halogen atom. As preferred examples of the perylene pigment, there can be mentioned N,N'-dimethylperylene-3,4,9,10-tetracarboxylic acid diimide, N,N'-di(3,5-dimethylphenyl)perylene-3,4,9,10-tetracarboxylic acid diimide, N,N'-di(4-ethoxyphenyl)perylene-3,4,9,10-tetracarboxylic acid diimide and N,N'-di(4-toluyl)perylene-3,4,9,10-tetracarboxylic acid diimide. Of course, the perylene pigments that can be used are not limited to those exemplified above.

The ratio of the perylene pigment and halogeno-p-benzoquinone to be dispersed in combination into PVK is important in the present invention. More specifically, in the present invention, the perylene pigment of the structural formula (1) is incorporated in an amount of 1 to 40 parts by weight, especially 4 to 20 parts by weight, per 100 parts by weight of PVK, and the halogeno-p-benzoquinone is incorporated in an amount of 1 to 60 parts by weight, especially 4 to 30 parts by weight, per 100 parts by weight of PVK. When the amount incorporated of the perylene pigment is too small and below the above range, even if the halogeno-p-benzoquinone is incorporated in combination, no effective sensitivity can be obtained. When the amount of the perylene pigment exceeds the above range, formation of a photosensitive layer by the film-forming technique becomes difficult and even if a photosensitive layer can be formed, the mechanical strength is very low and the abrasion resistance of the photosensitive layer is extremely poor. If the amount of the halogeno-p-benzoquinone is too small and below the above range, the sensitivity is reduced and the intended control of the fatigue at the repeated exposure cannot be attained. If the amount of the halogeno-p-benzoquinone exceeds the above range, a crystal of the halogeno-p-benzoquinone is precipitated on the photosensitive layer and a uniform photosensitive layer cannot be formed, and retention of charges on the photosensitive layer becomes difficult.

The polyvinyl carbazole resin used as the charge-transporting medium in the present invention is a polymer having the following recurring units:

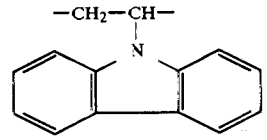

and this polymer has a film-forming property and an electron-donating characteristic. In the present invention, a nucleus substitution product of this polymer, for example, a halogen- or nitro-substituted polymer, can also be used.

If the perylene pigment as the charge-generating pigment is combined with other photoconductive pigment, the sensitive wavelength region of the photosensitive layer can be rendered more panchromatic. For example, the perylene pigment used in the present invention has a sensitivity to rays having a wavelength of 400 to 600 nm, and if a phthalocyanine pigment or disazo pigment is incorporated, the sensitivity to rays having a longer wavelength can be increased.

In order to increase the mechanical strength of the photosensitive layer and improve the adhesion to an electroconductive substrate, binders having no photoconductivity, such as a polyester resin, an epoxy resin, a polycarbonate resin, a polyurethane resin, a xylene resin, an acrylic resin and a styrene-butadiene copolymer, can be used. The binder may be used in an amount of 0.1 to 50 parts by weight, especially 10 to 30 parts by weight, per 100 parts by weight of the polyvinyl carbazole resin.

In order to improve the surface smoothness of the photosensitive layer, a levelling agent such as polydimethylsiloxane may be used in an amount of 0.005 to 5 parts by wight per 100 parts by weight of the polyvinyl carbazole resin.

The above-mentioned photosensitive composition of the present invention is coated in a certain thickness on an electroconductive substrate and is used as a photosensitive material for the electrophotography.

As the electroconductive substrate, there may be used foils or plates of metals such as aluminum, copper, tin and tinplate in the form of sheets or drums. Moreover, a film substrate such as a biaxially drawn polyester film or a glass sheet, to which a metal such as mentioned above is applied by vacuum deposition, sputtering or nonelectrode plating, or Nesa glass can be used as the electroconductive substrate.

The coating composition is prepared by dispersing the perylene pigment, optionally in combination with the phthalcyanine pigment or disazo pigment, into a good solvent for the polyvinyl carbazole resin, such as tetrahydrofuran, dichloroethane or toluene, cyclohexanone, by ultrasonic vibration or high shearing stirring, and dissolving the polyvinyl carbazole resin and the halogeno-p-benzoquinone in the resulting dispersion. From the viewpoint of the adaptability to the coating operation, it is preferred that the solid concentration of the formed coating composition be 5 to 12% by weight.

In the present invention, in view of the electrophotographic characteristics of the photosensitive material, it is preferred that the thickness of the photosensitive composition layer after drying be 3 to 30 microns, especially 8 to 15 microns.

The present invention will now be described in detail with reference to the following Examples that by no means limit the scope of the invention.

EXAMPLE 1

The following ingredients were charged in a stainless steel ball mill equipped with stainless steel balls and they were dispersed for 24 hours at a speed of 120 rotations per minute to form a photosensitive composition:

PVK (M-170 supplied by BASF)—100 g
N,N'-di(3,5-dimethylphenyl)perylene-3,4,9,10-tetracarboxylic acid diimide—8 g
Polyester resin (Vylon RV200 supplied by Toyobo)—10 g
2,5-dichloro-p-benzoquinone—20 g
Tetrahydrofuran—1200 g
Silicone oil (KF96 10CS supplied by Shinetsu Kagaku)—3 g The photosensitive composition was coated by a doctor blade to an anodized aluminum foil having a thickness of 80 microns, and the coated foil was dried for 1 hour in an oven maintained at 80° C. to obtain a photosensitive plate having a photosensitive layer thickness of 15 microns after drying.

The photosensitive plate was allowed to stand still in the dark place overnight, and the electrophotographic characteristics were determined according to the following procedures.

The test was carried out by using an electrostatic paper analyzer supplied by Kawaguchi Denki under the following conditions:

Measurement mode: stat 2
Applied voltage: +6.0 Kvolt
Quantity of applied rays: 40 lux The obtained results are as follows:

Half-decay exposure quantity: 12.0 lux·sec
Surface voltage: +620 volt

The repetition characteristics were examined according to the following procedures.

The photosensitive plate was attached to a PPC copying machine (Model DC-232 supplied by Mita Industrial Company), and the copying operation was repeated 1000 times under conditions of an applied voltage of +7.2 Kvolt, a destaticization AC voltage of 5.0 Kvolt and a transfer voltage of +6.0 Kvolt by using an original having a reflection density of 1.8. The surface voltage was measured by a surface potentiometer supplied by Monroe Co. while the copying operation was repeated. The obtained results are shown in FIG. 1. The surface voltage (598 volt) at the 1000th cycle was not substantially different from the surface voltage (600 volt) at the first cycle, and it was confirmed that the characteristics were very stable.

COMPARATIVE EXAMPLE 1

A photosensitive plate was prepared in the same manner as described in Example 1 except that 2,3-dichloro-1,4-naphthoquinone was used instead of 2,5-dichloro-p-benzoquinone used in Example 1, and the photosensitive plate was tested in the same manner as described in Example 1. The obtained results are as follows.

Electrophotographic Characteristics:

Half-decay exposure quantity: 11.2 lux·sec
Surface voltage: +600 volt

Repetition Characteristics:

The surface voltage at the first cycle was +600 volt, but it was reduced to +397 volt at the 1000th cycle. Thus, it was confirmed that extreme reduction of the charge quantity was caused and the characteristics were very unstable (see FIG. 1).

EXAMPLE 2

A photosensitive plate was prepared in the same manner as described in Example 1 except that 2,6-dichloro-p-benzoquinone was used instead of 2,5-dichloro-p-benzoquinone used in Example 1, and the photosensitive plate was tested in the same manner as described in Example 1. The obtained results are as follows.

Electrophotographic Characteristics:

Half-decay exposure quantity: 12.6 lux·sec
Surface voltage: +610 volt

Figure 2:
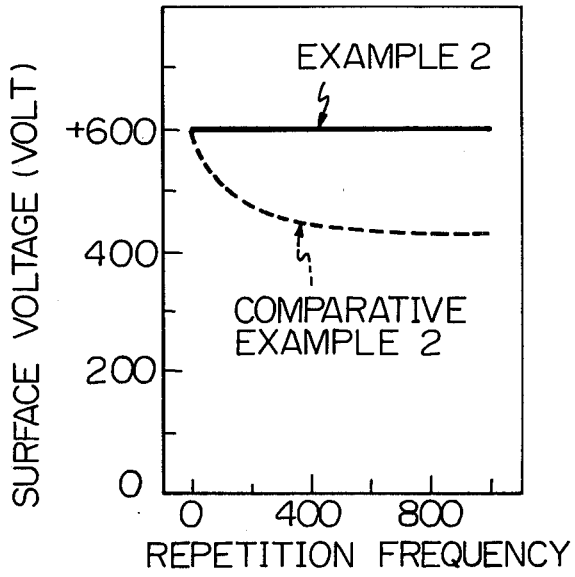

Repetition Characteristics:

The surface voltage (+590 volt) at the 1000th cycle was not substantially different from the surface voltage (+600 volt) at the first stage, and it was confirmed that the characteristics were very stable (see FIG. 2).

COMPARATIVE EXAMPLE 2

A photosensitive plate was prepared in the same manner as described in Example 1 except that 2,4,7-trinitro-9-fluorenone was used instead of 2,5-dichloro-p-benzoquinone used in Example 1. The photosensitive plate was tested in the same manner as described in Example 1. The obtained results are as follows.

Electrophotographic Characteristics:

Half-decay exposure quantity: 14.0 lux·sec
Surface voltage: +620 volt

The surface voltage at the first cycle was +600 volt, but it was reduced to +430 volt at the 1000th cycle, and it was confirmed that the charge quantity was drastically reduced and the characteristics were very unstable (see FIG. 2).

We claim:

1. A photosensitive material for the electrophotography, which comprises a dispersion of a charge-generating pigment in a charge-transporting medium composed mainly of a polyvinyl carbazole resin, wherein a perylene pigment represented by the following general formula:

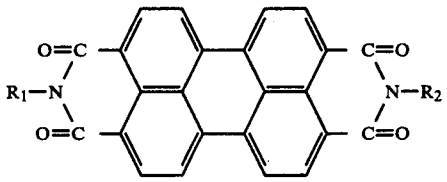

wherein $R_1$ and $R_2$ stand for a hydrogen atom or a substituted or unsubstituted alkyl or aryl group, is dispersed and incorporated as the charge-generating pigment in an amount of 1 to 40 parts by weight per 100 parts by weight of the polyvinyl carbazole resin and a halogeno-p-benzoquinone is further incorporated in an amount of 1 to 60 parts by weight per 100 parts by weight of the polyvinyl carbazole resin.

2. A photosensitive material as set forth in claim 1, wherein the halogeno-p-benzoquinone is 2,5-dichloro-p-benzoquinone.

3. A photosensitive material as set forth in claim 1, wherein the halogeno-p-benzoquinone is 2,6-dichloro-p-benzoquinone.

4. A photosensitive material as set forth in claim 1, wherein the perylene pigment is incorporated in an amount of 4 to 20 parts by weight per 100 parts by weight of the polyvinyl carbazole resin.

5. A photosensitive material as set forth in claim 1, wherein the halogeno-p-benzoquinone is incorporated in an amount of 4 to 30 parts by weight per 100 parts by weight of the polyvinyl carbazole resin.

* * * * *